United States Patent [19]

Kralowetz

[11] 4,430,881

[45] Feb. 14, 1984

[54] SWAGING MACHINE

[75] Inventor: Bruno Kralowetz, Steyr, Austria

[73] Assignee: GFM Gesellschaft Fur Fertigungstechnik Und Maschinenbau Gesellschaft M.B.H., Steyr, Austria

[21] Appl. No.: 334,580

[22] Filed: Dec. 28, 1981

[30] Foreign Application Priority Data

Jan. 21, 1981 [AT] Austria ..... 226/81

[51] Int. Cl.[3] ..... B21D 41/00

[52] U.S. Cl. ..... 72/402; 72/452

[58] Field of Search ..... 72/402, 451, 454, 452, 72/25

[56] References Cited

U.S. PATENT DOCUMENTS 3,572,077 3/1971 Kralowetz ..... 72/402

3,929,000 12/1975 Kralowetz ..... 72/452

FOREIGN PATENT DOCUMENTS 231695 2/1964 Austria ..... 72/402

*Primary Examiner*—Daniel C. Crane

*Assistant Examiner*—David B. Jones

*Attorney, Agent, or Firm*—Kurt Kelman

[57] ABSTRACT

A swaging machine comprises at least four radial rams, which are angularly apart and axially guided in the machine frame and held against rotation. Each ram is associated with a power screw, to which an oscillating angular motion can be imparted preferably by a rocker lever and an eccentric shaft. Screw-threaded drive trains actuate said power screws so as to impart the reciprocating swaging motion to the rams and to adjust their position. To provide a structure which is as simple, compact and inexpensive as possible, each power screw has two screw-threaded portions. One screw-threaded portion is operatively connected to a swaging drive train and in threaded engagement with mating screw threads of the associated ram. The other screw-threaded portion is in screw-threaded engagement with a rotatable adjusting nut of an adjusting drive train.

7 Claims, 3 Drawing Figures

FIG. 1
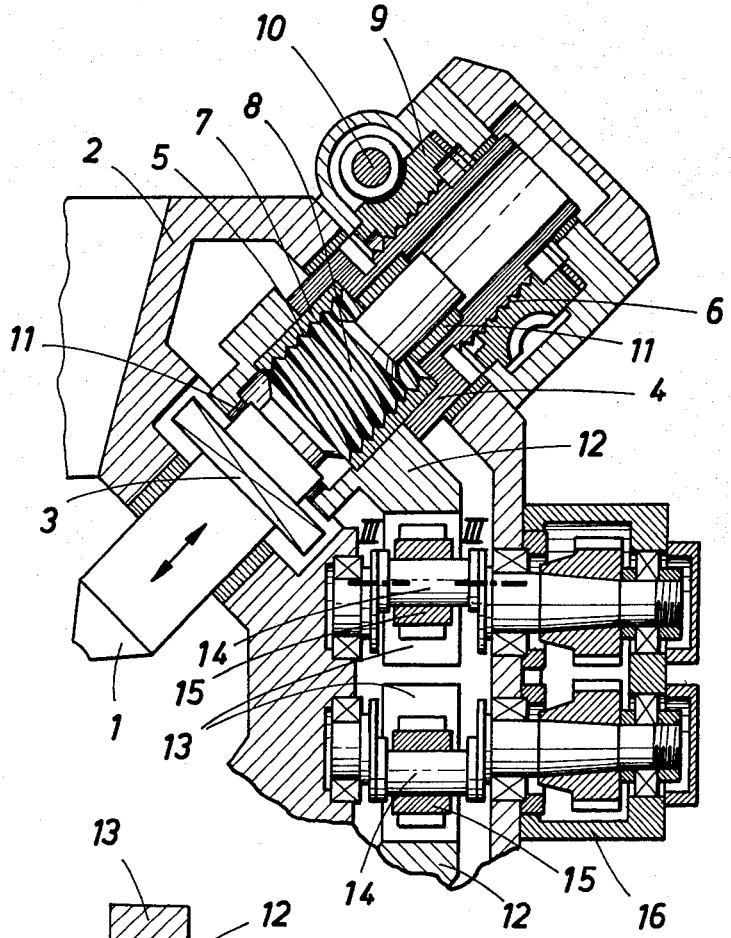
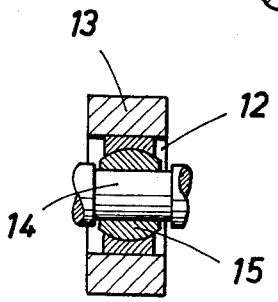
FIG. 3

SWAGING MACHINE

SUMMARY OF THE INVENTION

This invention relates to a swaging machine comprising at least four radial rams, which are angularly spaced apart and non-rotatably guided in the machine frame and operatively connected to respective power screws, screw-threaded swaging drive trains preferably comprising eccentric shafts and rocker levers, which are connected to associated power screws, and operable to impart to said power screws an oscillating angular motion so as to reciprocate said rams for a swaging operation, and screw-threaded drive trains for actuating said power screws so as to adjust the stroke position of the associated rams.

Such swaging machines comprising strictly mechanical screw-threaded drive trains for reciprocating and adjusting the rams have proved more satisfactory than hydraulic machines because they have no hydraulic compliance and than eccentric-driven machines because they involve a smaller structural expenditure. On the other hand, some difficulties arise owing to the reaction forces and reaction torques. For this reason, machines having four or more dies are mainly used because in such machines the means for driving the several dies can be operated in mutually opposite directions and can be arranged in such a manner that a torque or mass balance can be achieved.

In accodance with U.S. Pat. No. 3,929,000, the rams of four-die machines as well as the power screws associated with said rams are rotatably and axially immovably connected and each power screw has male screw threads in threaded engagement with female screw threads of a guide bushing. The latter is fixed in an adjusting sleeve. A rotation of the power screw will result in an axial movement thereof relative to the guide bushing. That axial movement of the drive screws is transmitted to the rams, which are non-rotatably mounted in the machine frame and can be reciprocated in that way. To permit an adjustment of the stroke position, the adjusting sleeves, which are rotatably mounted in the machine frame, can be rotated by means of a rocker arm. This rotation is transmitted to the guide bushings, which now cooperate with the male screw threads of the power screws so as to alter the stroke position of the rams. The means for imparting to the power screws the oscillating angular motion required to reciprocate the rams comprise rocker levers, to which a corresponding rocking motion is imparted by eccentric shafts. In that known machine the swaging forces are transmitted by the guide bushings to the adjusting sleeves and adjusting drive trains so that high loads are applied to the adjusting mechanism and the latter must be designed to have a high strength. Besides, the dimensions, complication, and manufacturing costs of the machine are greatly increased by that requirement.

U.S. Pat. No. 3,929,000 discloses a two-die machine in which the rams are reciprocated and adjusted by separate drive trains so that the screw threads of the power screw can be supported in a guide bushing that is fixed to the machine frame and the swaging forces are directly transmitted to the machine frame. In that machine, each ram is connected to the associated power screw by a connecting sleeve, which serves to adjust the stroke position. That connecting sleeve has female screw threads in threaded engagement with screw threads of the ram so that a rotation of the connecting sleeve will result in an axial displacement of the ram relative to the connecting sleeve and to the power screw. That structure is expensive and has a very large overall length and for that reason cannot be used in a four-die machine. Besides, in the known machines comprising two or more dies, suitable thrust bearings between the rams or connecting sleeves, on the one hand, and the drive screws, on the other hand, are essential and serve to transmit and apply the swaging forces. These thrust bearings require delicate and expensive elements of construction.

It is an object of the invention to eliminate these disadvantages and to provide a swaging machine which is of the kind described first hereinbefore and distinguishes by having a simple, compact and inexpensive structure.

This object is accomplished according to the invention in that each power screw has two screw-threaded portions, screw threads of one of said screw-threaded portions are in screw-threaded engagement with mating screw threads of the ram to reciprocate the latter, and the screw threads of the other of said screw-threaded portions are in screw-threaded engagement with an adjusting nut, which is adapted to be rotated, e.g., by a worm gear train. Because the screw-threaded portions of the power screws cooperate directly with the swaging and adjusting drive trains, respectively, this arrangement is compact and has a high stiffness and requires only a few, simple components. Owing to the cooperation provided by the invention between the power screws and the rams, a rotation of the power screws will reciprocate the rams so that no thrust bearings are required between the power screws and the rams. The power screws are supported by the adjusting nuts, which are engaged by the power screws with their second screw-threaded portion. The screw threads of the two screw-threaded portions need not be alike and the stress conditions can be strongly influenced by a selection of appropriate screw threads so that the power screws can be supported by the adjusting nuts without difficulty. The stroke position is adjusted in known manner by a worm gear train, which rotates the adjusting nut so that the power screw is axially displaced. As the power screw is incorporated in the swaging drive train and the adjusting drive train, the oscillating angular motion imparted to the power screw in order to reciprocate the associated ram will cause the power screw to rotate also relative to the adjusting nut and an axial movement caused by the adjusting drive train will thus be superposed on the axial movement imparted to the power screw by the swaging drive train. The resulting sum effect can be influenced as desired by the selection of suitable screw threads. It will be understood that the power screws can be rotated by any suitable means and that the oscillating motions of the several drive trains will be adjusted so that a mass balance will be obtained. The use of the feature of the invention thus permits the design of a compact, efficient multiple-die machine which has a simple and inexpensive structure.

If, in accordance with the invention, the screw threads associated with the adjusting drive train have a smaller lead than the screw threads of the swaging drive train, the forces to be taken up by the adjusting nut and the adjusting drive train in general will be small and that component of the reciprocating movement which is due to the adjusting drive train will be negligible.

In a structurally desirable embodiment of the invention the power screws are hollow and receive the rams and the screw threads provided on the power screws and serving to reciprocate the rams are female screw threads, which cooperate with mating male screw threads of the rams. The female screw threads of the power screws are preferably formed on a tapped bushing, which is fixed in the power screw. The resulting screw-ram assembly is relatively short and very stiff and the female screw threads can easily be formed in the bushing, which is subsequently inserted into the body of the power screw. The insertion of that tapped bushing into the power screw will be facilitated if the body of the power screw is longitudinally divided into two parts although that feature is significant only for the assembling or manufacture of the power screw but is not significant for its function.

as a trouble-free operation of the swaging drive train with low friction depends in a high degree on the exact association between the power screws and rams, particularly the screw threads of the latter, a feature of the invention resides in that guides for the associated ram are provided inside each power screw on both sides of its female screw threads. These guides ensure that the rams will always have the proper orientation in the power screws in spite of the relative movement between the power screws and rams.

BRIEF DESCRIPTION OF DRAWING

An illustrative embodiment of the invention is strictly diagrammatically shown on the accompanying drawings, in which FIG. 1 shows a swaging machine according to the invention partly in cross-section, FIG. 2 is an end view showing that swaging machine on a smaller scale and FIG. 3 is a fragmentary section along line III—III of FIG. 1.

Figure 2:
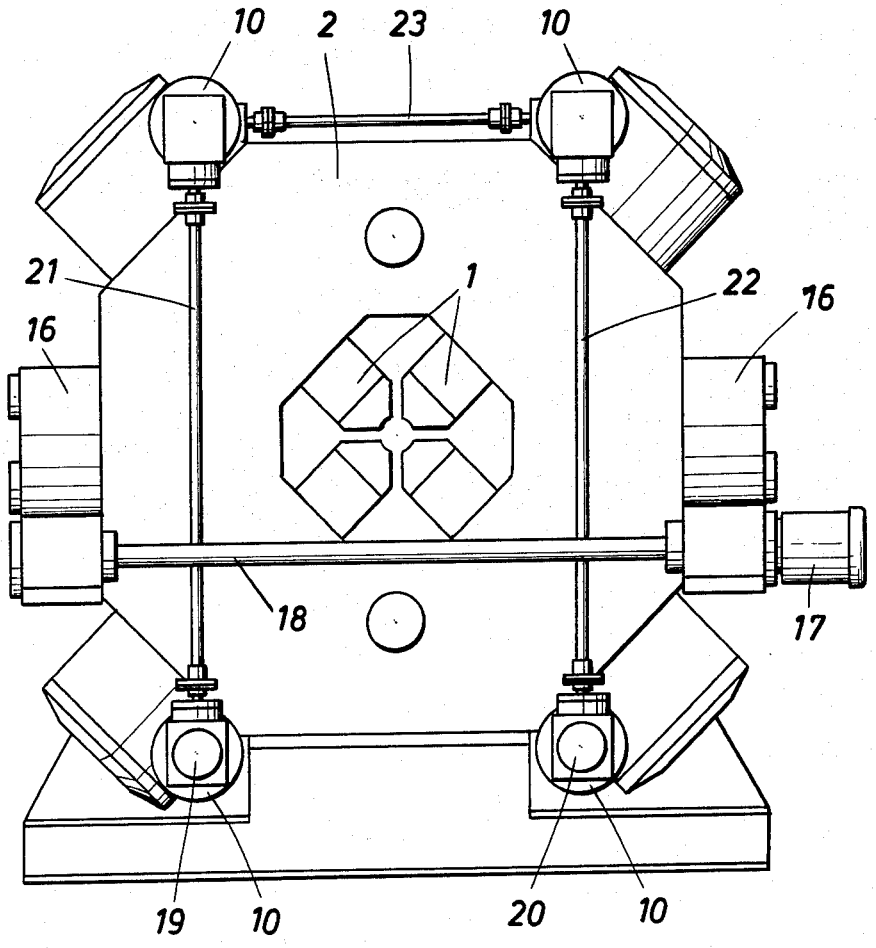

The illustrated swaging machine comprises four rams 1, which are spaced 90 degrees apart and axially guided in the machine frame 2 and held against rotation by suitable means 3. A power screw 4 mounted in the machine frame 2 is associated with each ram 1 and coaxial thereto and comprises two screw-threaded portions 5, 6. The screw-threaded portion 5 is associated with the swaging drive train and comprises female screw threads formed in a tapped bushing 7, which is fixed in the power screw; these screw threads cooperate with male screw threads 8 of the ram 1. The other screw-threaded portion 6 is screwed in an adjusting nut 9, which is mounted in the machine frame 2 and rotatable by a worm gear train 10. Each power screw 4 is internally provided on opposite sides of the tapped bushing 7 with guides 11 in sliding engagement with the rams 1, which protrude into the respective power screws; these guides 11 ensure that the rams and power screws will have the proper orientation relative to each other.

A rocker lever 12 is connected to each power screw 4 and has a forked end portion 13, which extends at an angle of 45° to the remainder of the rocker lever and cooperates with an eccentric shaft 14, to which the rocker lever 13 is connected by a universal joint 15 and permits a relative movement between the rotating eccentric shaft and the rocker lever 12. The eccentric shaft imparts an oscillating angular motion to the rocker lever 12 about the axis of the power screw. That oscillating motion of the rocker lever 12 imparts an oscillating angular motion to the power screw 4 so that the associated ram 1 is reciprocated by means of the tapped bushing 7 and the screw threads 8. The swaging forces which are exerted on the workpiece to swage the latter as a result of this reciprocating motion are transmitted by the screw-threaded portion 6 to the adjusting nut 9. At the same time, an additional axial motion is imparted to the power screw 4 as it performs an oscillating angular motion in the adjusting drive train 6, 9 and is superposed on the reciprocating motion caused by the swaging drive train 5, 8. The lead of the screw threads of the adjusting drive train is suitable a small fraction of the lead of the screw threads of the swaging drive train so that the force to be taken up will remain within small limits and can easily be taken up by the adjusting drive train. In that case the axial component of motion imparted to the power screw 4 by the adjusting drive train will be virtually negligible. Such properties may be selected for the two power screw trains 6, 9 and 5, 8 as regards lead and hand that all conditions regarding motion and support can be properly influenced so that the structural expenditure will be further decreased.

To ensure a mass balancing of the oscillating drive trains associated with the rams, the two eccentric shafts 14 associated with two adjacent rams rotate in mutually opposite senses. For this purpose, suitable idler gears, not shown, are provided in the common gearbox. The power source for all swaging units consists of a drive motor 17, which has a drive shaft 18, which is connected to two gearboxes 16, which are associated with respective pairs of swaging units. Two adjusting motors 19, 20 are provided for adjusting the stroke position and can be operated to move by means of connecting shafts 21, 22, 23 the worm gear trains 10 and by the latter the adjusting nuts 9. If two adjusting motors 19, 20 are provided, the adjusting drive trains may be operated in pairs of mutually opposite drive trains. If there is only a single adjusting motor, which must be coupled to all adjusting drive trains, all four adjusting drive trains can be operated only in unison.

The swaging machine according to the invention has a paricularly simple and compact structure and may be made from a few structural parts and has extremely small dimensions and can be made at very low cost.

What is claimed is:

1. In a swaging machine comprising a machine frame, at least four angularly spaced apart, radially extending rams longitudinally guided in said machine frame and held against rotation therein, a plurality of power screws, each of which is rotatably mounted in said machine frame and operatively connected to one of said rams, a plurality of swaging drive trains, each of which is operable to impart an oscillating angular motion to one of said power screws so as to reciprocate the associated ram for a swaging operation, and a plurality of adjusting drive trains, each of which is operable to actuate one of said power screws so as to adjust the stroke position of the associated ram, the improvement residing in that each of said power screws has a first screw-threaded portion associated with a respective one of the swaging drive trains, each of said rams has screw threads in threaded engagement with said first screw-threaded portion of the associated power screw, each of said power screws has a second screw-threaded portion associated with a respective one of the adjusting drive trains, and each of said adjusting drive trains comprises an adjusting nut having female screw threads in threaded engagement with said second screw-threaded portion of the associated power screw.

2. The improvement set forth in claim 1, in a swaging machine in which each of said swaging drive trains comprises a rocker lever fixed to the associated power screw and an eccentric shaft which is rotatable to impart an oscillating angular motion to said rocker lever about the axis of the associated power screw.

3. The improvement set forth in claim 1, wherein each of said adjusting drive trains comprises a worm gear train operable to rotate said adjusting nut.

4. The improvement set forth in claim 1, wherein each of said power screws is hollow and has female screw threads which constitute said first screw-threaded portion, and each of said rams has male screw threads in threaded engagement with said female screw threads of the associated power screw.

5. The improvement set forth in claim 4, wherein each of said first screw threaded portions comprises a tapped bushing formed with said female screw threads.

6. The improvement set forth in claim 4, wherein each of said power screws is provide with internal guides, which are disposed on opposite ends of said female screw threads of said power screw and each of said rams is in sliding engagement with said guides of the associated power screw.

7. The improvement set forth in claim 1, wherein the screw threads of the second screw-threaded portion have a smaller lead than the screw threads of the first screw-threaded portion.

* * * * *